US006918794B2

(12) United States Patent
Wan et al.

(10) Patent No.: US 6,918,794 B2
(45) Date of Patent: Jul. 19, 2005

(54) MODULAR JACK HAVING AN ANTI-MISMATING MEMBER TO PREVENT INCORRECT INSERTION OF A SMALLER SIZED PLUG

(75) Inventors: Qing Wan, Kunsan (CN); Qisheng Zheng, Kunsan (CN); Hong Jun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/683,201

(22) Filed: Oct. 9, 2003

(65) Prior Publication Data

US 2004/0235358 A1 Nov. 25, 2004

(30) Foreign Application Priority Data

May 9, 2003 (TW) ..... 92208546 U

(51) Int. Cl.[7] ..... H01R 24/00
(52) U.S. Cl. ..... 439/676
(58) Field of Search ..... 439/676–680

(56) References Cited

U.S. PATENT DOCUMENTS 6,186,835 B1 2/2001 Cheshire ..... 439/676
6,296,528 B1 10/2001 Roberts et al. ..... 439/676
6,319,070 B1 * 11/2001 Tan ..... 439/680
6,350,156 B1 * 2/2002 Hasircoglu et al. ..... 439/676
6,354,884 B1 * 3/2002 Yeh et al. ..... 439/680
6,806,427 B2 * 10/2004 Kadotani et al. ..... 174/70 C

* cited by examiner

*Primary Examiner*—Michael C. Zarroli
(74) *Attorney, Agent, or Firm*—Wei Te Chung

(57) ABSTRACT

A modular jack (100) includes an insulative housing (1) having a plug-receiving cavity (10), a number of conductive terminals (322) and an anti-mismating member (2) received in the housing (1) and a metal shell (4) shielding the housing (1). The anti-mismating member (2) includes a metal main portion (21) having a horizontal spring arm (212) and an insulative portion (22). The insulative portion (22) is located at a free end of the spring arm (212) and includes a sliding surface (222) and a stop surface (221) attached to an inner side of the sliding surface (222) at a free end thereof. When an undersized plug is inserted into the cavity (10), the leading edge of the undersized plug contacts the stop surface (222), preventing full insertion of the undersized plug into the cavity (10). When a mating plug is inserted into the cavity (10), the leading edge of the mating plug contacts the more forwardly-positioned sliding surface (222) before reaching the stop surface (221). This movement produces a corresponding movement in the anti-mismating member (2) and the stop surface (221) thereon such that the stop surface is located out of engagement with the leading edge of the mating plug, permitting full insertion of the mating plug into the cavity.

7 Claims, 4 Drawing Sheets

MODULAR JACK HAVING AN ANTI-MISMATING MEMBER TO PREVENT INCORRECT INSERTION OF A SMALLER SIZED PLUG

BACKGROUND OF THE INVENTION

1. Field of the Invention

The present invention relates to connectors, and especially to a modular jack designed to prevent improper insertion of smaller sized plug connector.

2. Description of the Prior Art

RJ-11 and RJ-45 receptacles respectively engaging with RJ-11 and RJ-45 plugs are commonly used in network communications. RJ-45 receptacle and plug have larger dimensions than RJ-11 receptacle and plug. Therefore, an RJ-11 plug or any smaller sized RJ plug may be inadvertently inserted into an RJ-45 receptacle, which may result in damage to the terminals of the RJ-45 receptacle. U.S. Pat. No. 6,186,835 B1 issued to Cheshire on Feb. 13, 2001 disclosed a conventional modular jack. The modular jack comprises an insulative housing and an anti-mismating member integrally formed on a jack entry leading into the jack cavity. The anti-mismating member has a ramp attached to the jack entry. The ramp has an inner movable end with a vertical barrier. An undersized inserted plug is blocked by the vertical barrier. A full-sized inserted plug engages with the ramp, rides along and moves the flexible ramp. The vertical barrier moves out of a stopping position, therefore allowing the full-sized inserted plug to be fully seated in the cavity. However, the anti-mismating member formed is integrally with the insulative housing, which makes manufacturing of the insulative housing complicated. Moreover, the anti-mismating member is made from plastic material and will loose its flexibility after repeated use.

U.S. Pat. No. 6,296,528 B1 issued to Roberts et al on Oct. 2, 2001 disclosed another conventional modular jack. The modular jack comprises an insulative housing defining a plug-receiving cavity and a pair of anti-mismating members received in the insulative housing. Each anti-mismating member comprises a sliding surface and a stop surface attaches to an inner side of the sliding surface at a free end thereof. The stop surface is provided for blocking an undersized plug being inserted. When a mating plug is inserted into the cavity, the leading edge of the mating plug contacts the more forwardly-positioned sliding surface before reaching the stop surface and rides along the sliding surface, which causes the sliding surface to move upwardly. The movement produce a corresponding movement in the anti-mismating member and the stop surface thereon such that the stop surface is located out of a stop position, permitting full insertion of the mating plug into the cavity. However the anti-mismating members are made discretely, more constituent parts produce an incompact frame. Also, similar to the aforementioned U.S. Pat. No. 6,186,835, for forming a relative larger and reinforced stop surface, that anti-mismating member is made of plastic thus resulting in losing flexibility after repeated use. On the other hand, U.S. Pat. No. 6,257,935 discloses the anti-mismating member made of metal for superior flexibility thereof. Anyhow, such anti-mismating member may only provide a thin planar stop surface confronting the undersized plug, thus result in possibly tilting or damage of the anti-mismating member if the plug is improperly severely obliquely inserted into the jack. Thus, it is desired to have a new type anti-mismating member which has not only the superior resilience for enduring repeated use but also the reinforced stop surface for resisting any improperly server oblique insertion of the plug so as not to be damaged.

BRIEF SUMMARY OF THE INVENTION

An object of the present invention is to provide a modular jack with a durable anti-mismating member having a simple structure for preventing an improper insertion of an undersized plug.

A modular jack of the present invention comprises an insulative housing having a plug-receiving cavity, a plurality of terminals and a anti-mismating member received in the housing and a metal shell shielding the housing. The anti-mismating member comprises a metal main portion having a horizontal spring arm and an insulative portion. The insulative portion is located at a free end of the spring arm, including a sliding surface and a stop surface attached to an inner side of the sliding surface at a free end thereof. When an undersized plug is inserted into the cavity, the leading edge of the undersized plug contacts the stop surface, preventing full insertion of the undersized plug into the cavity. When a mating plug is inserted into the cavity, the leading edge of the mating plug contacts the more forwardly-positioned sliding surface before reaching the stop surface. This movement produces a corresponding movement in the anti-mismating member and the stop surface thereon such that the stop surface is located out of engagement with the leading edge of the mating plug, permitting full insertion of the mating plug into the cavity.

DETAILED DESCRIPTION OF THE INVENTION

Figure 1:
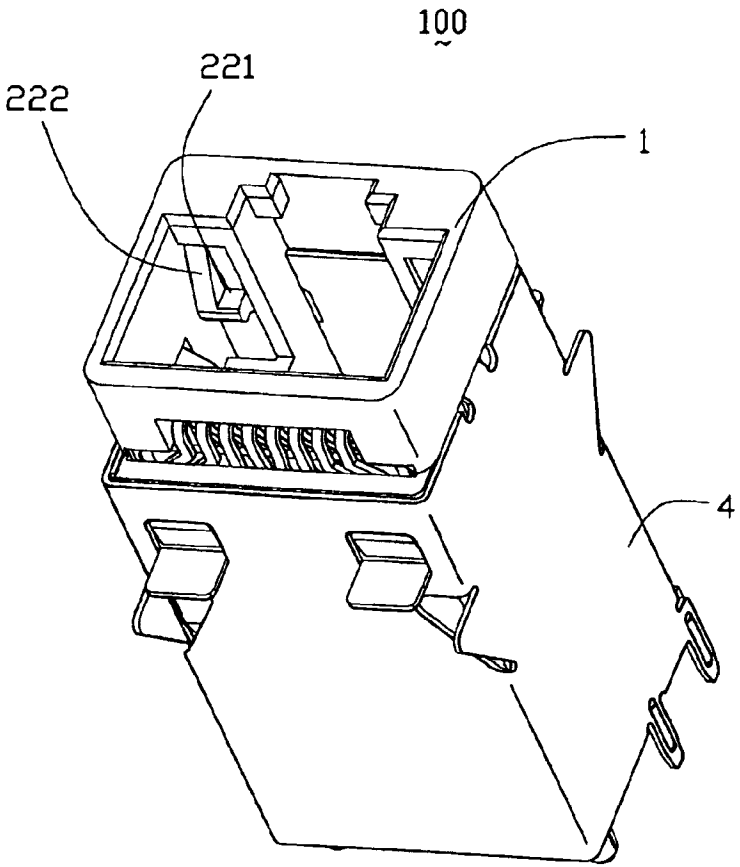
FIG. 1 is a perspective view of a modular jack according to the present invention.
Figure 2:
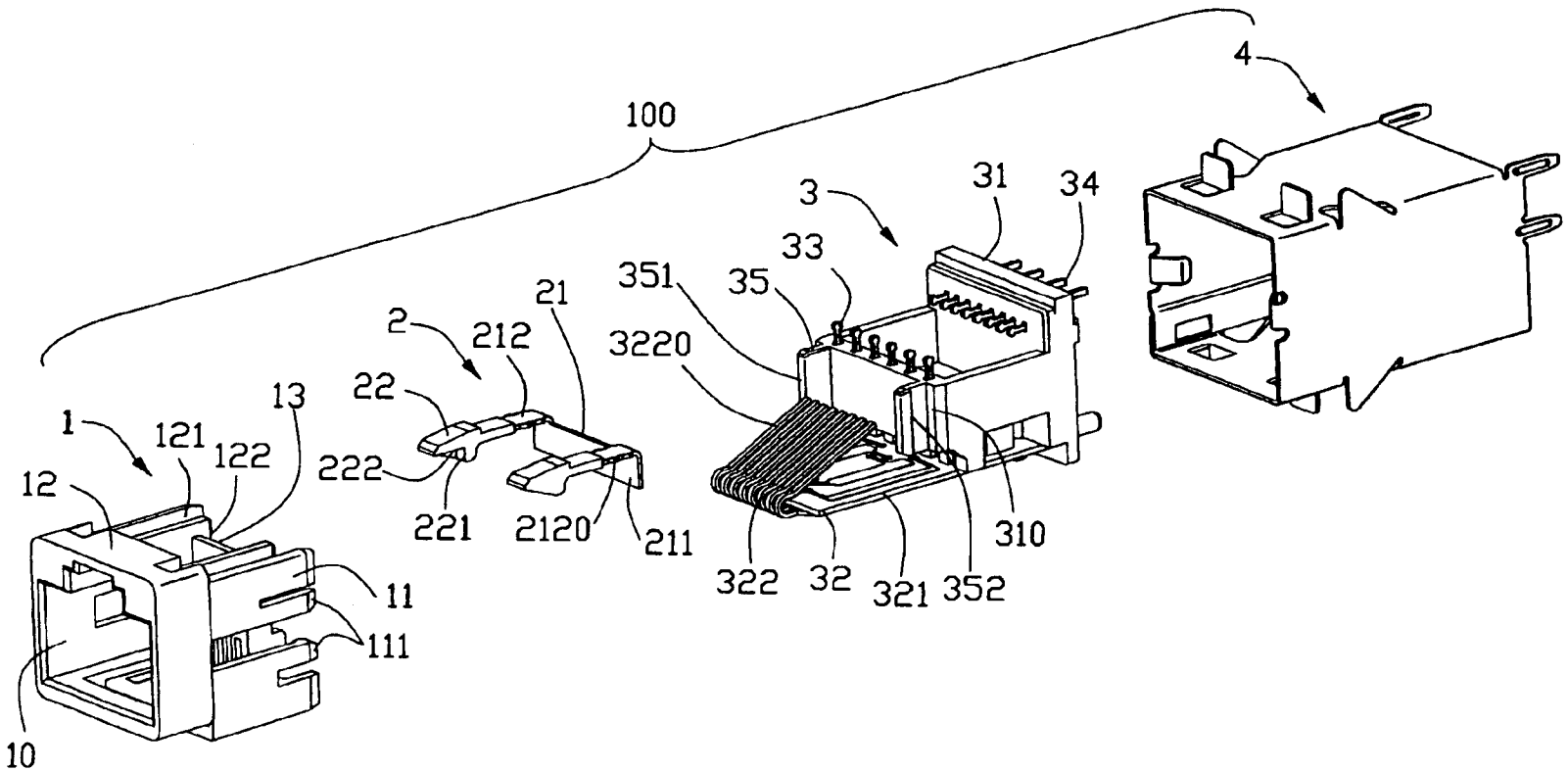
FIG. 2 is an exploded view of the modular Jack of FIG. 1.
Figure 3:
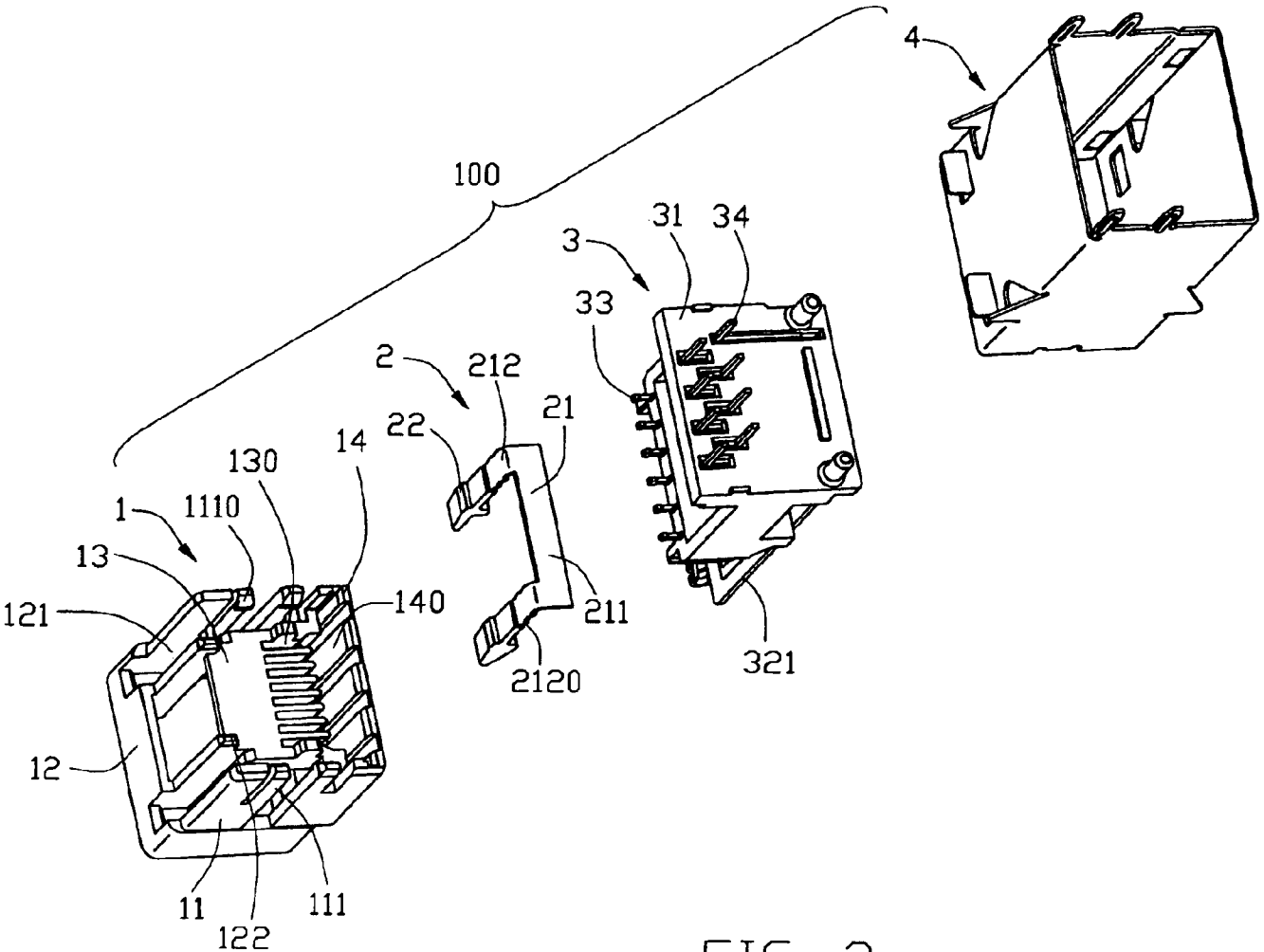
FIG. 3 is another exploded view of the modular Jack of FIG. 1 from a different aspect.
Figure 4:
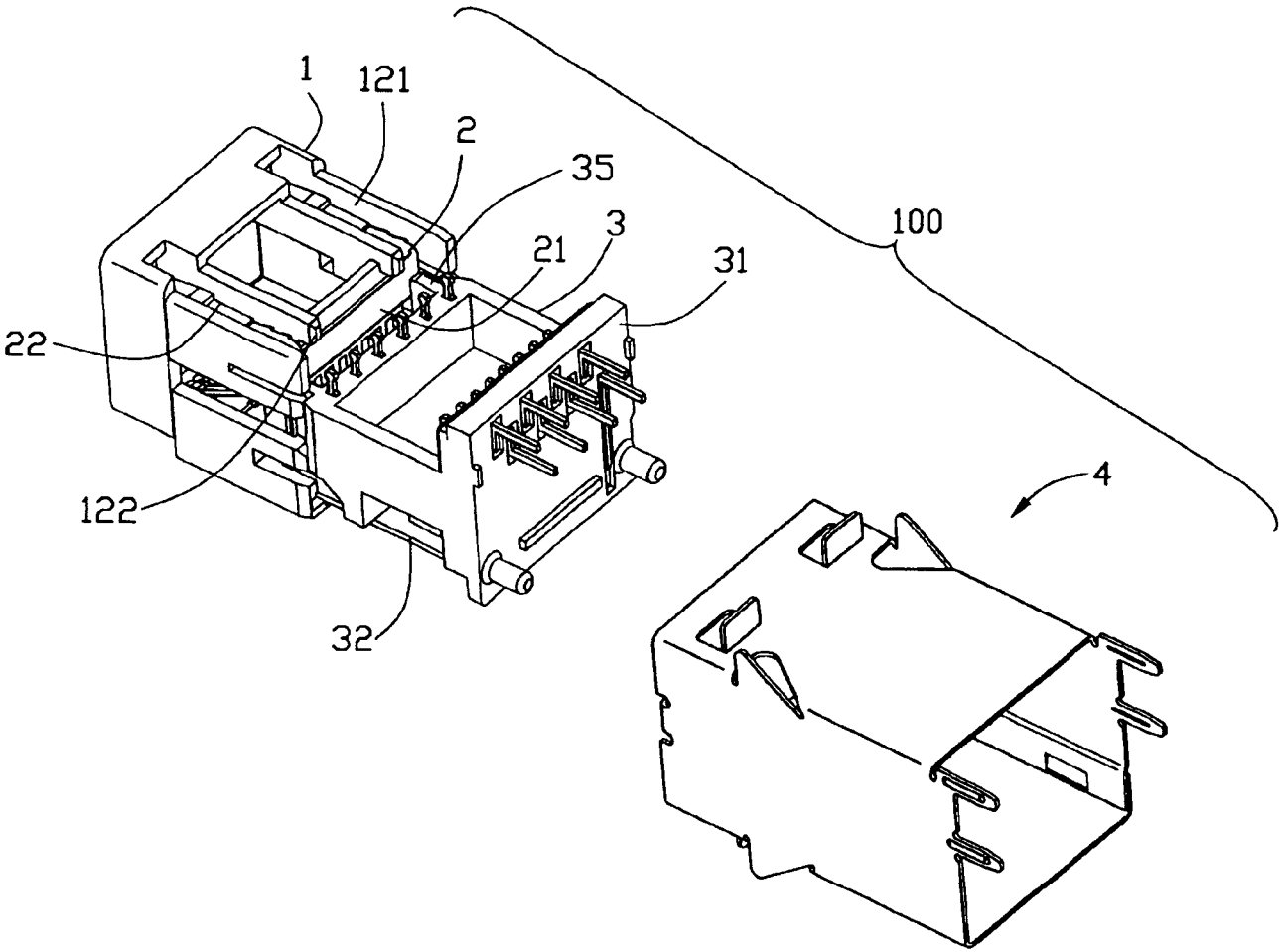
FIG. 4 is a partially assembled view of the modular Jack.

Referring to FIGS. 1 and 3, a modular jack 100 comprises an insulative housing 1, an anti-mismating member 2 and a terminals-receiving part 3 received in the housing 1 and a metal shell 4 shielding the insulative housing 1.

The housing 1 comprises a pair of side walls 11, a top wall 12, a rear wall 13, a bottom wall 14 and a plug-receiving cavity 10 defined therebetween. Each side wall 11 includes a pair of engaging arms 111 extending rearwardly and a first latches 1110 at a free end of the engaging arms 111. The top wall 12 includes a pair of receiving grooves 121 respectively adjacent to a corresponding side wall 11 and receiving the anti-mismating member 2. Each receiving groove 121 communicates with the cavity 10 in a front portion thereof. The top wall 12 includes a pair of protruding ends 122 extending rearwardly beyond the rear wall 13. In this embodiment, the protruding ends 122 extend rearwardly from an inner side of the receiving grooves 121. The rear wall 13 includes a plurality of slits 130 communicating with the cavity 10 at a lower middle portion thereof. The bottom wall 14 and the side walls 11 define a receiving space 140 therebetween. The receiving space 140 communicates with the cavity 10 and is provided for receiving a terminals module 32 (will be described later) in the terminals-receiving part 3.

The anti-mismating member 2 is received in the housing 1 and includes a metal main portion 21 and a pair of insulative portions 22 at front ends of the metal main portion 21. The metal main portion 21 is integrally made of a metal shell and includes a vertical portion 211 and a pair of spring arms 212 extending forwardly from opposite sides of the vertical portion 211. Each spring arm 212 includes a plurality of barbs 2120 on both sides of a rear portion thereof. The insulative portion 22 is integrally made from insulative material and ejected to a front portion of the spring arm 212, including an inclined surface 222 at a free end thereof and a stop surface 221 on an inner side of the inclined surface 222.

The terminals-receiving part 3 is attached to a rear portion of the housing 1, including a base portion 31 and terminals module 32 positioned forwardly and connected to the base portion 31. The base portion 31 includes a front end (no labeled) and a rear end (no labeled). The front end includes a front end face 310 and a plurality of transferring terminals 33 connecting electrically to the terminals module 32. The rear end includes a plurality of footer terminals 34 connecting to a mother board (not shown). The transferring terminals 33 are electrically connected to some of the footer terminals 34 via a plurality of electronic element, such as magnetic coils. The front end face 310 includes a pair of protruding arms 35. Each protruding arm 35 includes a front face 351 and a second latch 352 at a front end thereof. The terminals module 32 includes a daughter board 321 connecting to the base portion 31 and a plurality of conductive terminals 322 connecting to the daughter board 321. Each conductive terminal 322 includes a contact portion 3220. Some of the conductive terminals 322 are connected to the transferring terminals 33.

Referring to FIGS. 1, 2, 3 and 4, in assembling, firstly, the anti-mismating member 2 is inserted into the insulative housing 1 from the receiving grooves 121, and a plurality of barbs 2120 of the spring arms 212 are engaged with the receiving grooves 121. The insulative portions 22 extend into the receiving groove 121 and are exposed to the cavity 10 of the housing 1. The vertical portion 211 of the metal main portion 21 of the anti-mismating member 2 abuts against the rear wall 13 of the housing 1. A top end of the vertical portion 211 attaches to the protruding ends 122. Secondly, the terminals module 32 of the terminals-receiving part 3 is received in the receiving space 140 of the bottom wall 14. The contact portions 3220 of the conductive terminals 322 of the terminals module 32 extend into the cavity 10 through the slits 130 of the rear wall 13. The terminal-receiving part 3 is mounted to the insulative housing 1 via engaging of the second latches 352 of the protruding arm 35 of the terminal-receiving part 3 with the first latches 1110 of the engaging arms 111 of the side walls 11. The front face 351 of the protruding arm 35 supports the vertical portion 21 of the anti-mismating member 2. Finally, the shell 4 covers the insulative housing 1 and the terminals-receiving part 3.

Referring to FIG. 1, a mating plug (not shown) is inserted into the modular jack 100, a front portion of the mating plug is received in the cavity 10 of the housing 1. The front portion of the mating plug contacts and pushes the inclined surface 222 of the insulative portion 22 to move upwardly, then the stop surface 221 of the insulative portion 22 of the anti-mismating member 2 moves upwardly together with the inclined surface 222 and moves away from the stop position. Thus, the front portion of the mating plug is not engagable with the stop surface and fully inserted into the cavity 10. The mating pug is withdrawn from the modular jack 100, the spring arms 212 of the anti-mismating member 2 releases the spring and the anti-mismating member 2 returns to the initial position.

An undersized plug (such as an RJ-11 plug) is inserted into the modular jack 100, owing to a smaller width in the front portion of the undersize plug, the leading edge of the undersize plug is not able to contact the inclined surface 222 and contact the stop surface 221 of the anti-mismating member 2 directly. Because of stopping of the stop surface 221, the undersize plug is not able to be inserted into the modular jack 100 any further.

The anti-mismating member 2 of the modular jack 100 includes the metal main portion 21 and the insulative portion 22. The metal main portion 21 has higher flexing resistant performance, thus increasing life of the anti-mismating member 2. Moreover, the metal main portion 21 and the insulative portion 22 are made respectively then mounted together, or the insulative portion 22 is punched to the metal main portion 2. The above-stated manufacturing methods are simple, compared to the antecede art.

The modular jack 100 described above is a preferred embodiment of the present invention. Of course there are still many other embodiments, for example, the modular jack 100 has a pair of separately formed anti-mismating members, each of which respectively includes a vertical portion 211 and an insulative portion 22 extending forwardly from the vertical portion.

It is to be understood, however, further though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent identify by the broad general meaning of the terms in which the appended claims are expressed.

What is claimed is:

1. A modular jack, which permits insertion of a full sized plug and prevents insertion of a smaller sized plug, comprising:

an insulative housing having a plug-receiving cavity;

a plurality of conductive terminals each including a contact portion extending into the plug-receiving cavity; and an anti-mismating member mounted to a rear portion of the insulative housing, the anti-mismating member comprising a metal main portion and an insulative portion extending forwardly from the metal main portion, the insulative portion including an inclined surface at a free end thereof and a top surface on an inner side of the inclined surface, the inclined surface being urgeable upwardly by an inserted full-sized mating plug to clear the stop surface off the path of plug insertion, the stop surface upon being contacted by an inserted smaller sized plug preventing the smaller sized plug from being inserted further wherein the insulative housing comprises a top wall, the top wall comprising a receiving groove accommodating a spring arm and the insulative portion of the anti-mismating member, the spring arm comprising a plurality of barbs engaging with the receiving groove.

2. The jack according to claim 1, wherein the receiving groove communicates with the cavity, the insulative portion extending into the cavity.

3. The jack according to claim 1, wherein the insulative housing comprises a rear wall, and the metal main portion abuts against the rear wall.

4. The jack according to claim 3, wherein the top wall of the insulative housing comprises a pair of protruding ends attaching to the metal main portion.

5. The jack according to claim 1, wherein the modular jack comprises a terminals-receiving part attached to a rear portion of the housing, the terminal receiving part comprising a terminals module and a base portion, the conductive terminals being secured in the terminals module, the base portion comprising a protruding arm abutting against the metal main portion.

6. The jack according to claim 5, wherein the insulative housing comprises a side wall, the side wall comprising an engaging arm engaging with the protruding arm, each of the engaging arm and the protruding arm comprising an engaging latch.

7. A modular jack comprising:

an insulative housing defining a plug-receiving cavity therein:

a plurality of terminals disposed in the housing with corresponding contact portions extending into the cavity; and an anti-mismating member disposed in the housing around the cavity, said anti-mismating member including of the anti-mismating member during deflection of the anti-mismating member, and an insulative portion secured at a front end of the main body, said insulative portion defining a thickness relatively lager than that of said main body, said insulative portion further defining, along a transverse direction, an inner stop surface for stopping an under sized plug and an outer actuation surface for being urged to deflect the main body by a correctly sized plug; wherein said insulative portion extends into the cavity and is adapted to engage the inserted plug regardless of the undersized one or the correct one substantially rather than the metal main body wherein said insulative portion defines an inclined surface is urgeable upwardly by the correctly sized plug.

* * * * *